United States Patent [19]

Couper et al.

[11] Patent Number: 4,504,828

[45] Date of Patent: Mar. 12, 1985

[54] EXTERNAL ATTRIBUTE LOGIC FOR USE IN A WORD PROCESSING SYSTEM

[75] Inventors: Robert A. Couper, Sunnyvale; Terrance L. Lillie, Palo Alto; Kiyoshi Sera, San Jose, all of Calif.

[73] Assignee: Pitney Bowes Inc., Stamford, Conn.

[21] Appl. No.: 406,654

[22] Filed: Aug. 9, 1982

[51] Int. Cl.[3] ..... G09G 1/24

[52] U.S. Cl. ..... 340/735; 340/748; 340/750; 340/799

[58] Field of Search ..... 340/735, 748, 749, 750, 340/799, 800, 801; 364/521, 523

[56] References Cited

U.S. PATENT DOCUMENTS

| | | | |
|---|---|---|---|
| 3,996,584 | 12/1976 | Plager | 340/748 |
| 4,158,837 | 6/1979 | Zahorsky | 340/750 |
| 4,316,188 | 2/1982 | Cancasci, Jr. | 340/735 |
| 4,414,545 | 11/1983 | Sakurada et al. | 340/735 |
| 4,439,761 | 3/1984 | Fleming et al. | 340/748 |
| 4,451,825 | 5/1984 | Hall et al. | 340/735 |

*Primary Examiner*—Gerald L. Brigance

*Attorney, Agent, or Firm*—Robert H. Whisker; Albert W. Scribner; William D. Soltow, Jr.

[57] ABSTRACT

A circuit for controlling attributes of a plurality of characters on a display. The circuit has a processor for controlling transfer of data associated with characters to be displayed and a communications device connected to the processor. A display controller is also provided for controlling the display of characters. An external controller is connected to the communications device and to the display controller for providing attributes corresponding to the displayed characters. The external controller also has provision for controlling the display of a set of characters in addition to the set normally controlled by the display controller.

5 Claims, 19 Drawing Figures

DMA CONTROLLER

IO
8085A-2
ALE
S0
S1
A8
A9
A10
A11
A12
A13
A14
A15
SID
HLDA
HOLD
RESET IN
SOD
DOUT
SIP 6-7
LS10
LS04
LS08
LS00
LS27
LS112
LS125
MSTR
RESET
BBSY
HLDA
HOLD
IO4
CPUID/BUSCON/CLR 5.5
IOWR
ADD 10
ADD 9
ADD 8
SLAVE
BSLCR
MR
BCK
BPRIN
BPROUT
J1
112
114
116

SLAVE ADDRESS COMPARATOR

EXTERNAL ATTRIBUTE LOGIC FOR USE IN A WORD PROCESSING SYSTEM

BACKGROUND OF THE INVENTION

1. Field of the Invention

The present invention relates to displayable characters and more particularly to attributes for characters displayable in a word processing system.

2. Description of the Prior Art

It is desirable in word processing equipment having a display to generate an image on the display which replicates, as nearly as possible, the information which is ultimately printed on a document. In addition to substantive character identifying information, this accurate replication includes attributes of the characters, some of which can be ultimately printed on the document. Typical character attributes include bolded characters, blinking characters, reverse video characters (dark characters on light background), underscored characters and double underscored characters.

Examples of character attributes and their uses are described in co-pending patent application entitled, "Circuit for Controlling Character Attributes in a Word Processing System Having a Display", Ser. No. 177,651, filed Aug. 12, 1980, which issued as U.S. Pat. No. 4,422,070 Dec. 20, 1983.

Two common methods of providing attribute information have heretofore been used in conventional word processing systems. The first method requires the use of character spaces on the display to represent an attribute. This method is not desirable in word processing applications where importance is placed on displaying characters and their locations with respect to each other as they would appear when printed or typed. The use of character spaces to represent attributes, therefore, is unacceptable both due to the positioning of characters relative to each other and due to the resulting detrimental effect on the margins of the lines in which these spaces occur.

The second common method of providing attribute information requires no character spaces but uses so-called invisible attributes, provided as a function of a cathode ray tube (CRT) controller, such as a Model No. 8275 CRT controller available from the Intel Corp. This device has provision for only 16 attributes, however, which is insufficient for defining one or more attributes per character for up to 80 characters on each line of displayed text.

Another problem encountered in word processing systems can be related to the aforementioned methods of handling character attribute information. This is the problem of providing one or more sets of characters in addition to a standard set of characters. It is often desirable to be able to print or display characters used in languages such as Greek, Russian, French or Japanese, in addition to English. Similarly certain characters are often required for scientific or mathematical documents. Moreover, type styles such as elite, pica, gothic, italics and modern may be used frequently in certain situations.

Word processing systems generally cannot accommodate the visual display of such stylistic demands, or can accommodate them only approxmately and with a considerable amount of effort. For example, a common technique of obtaining a printout of extraordinary characters such as those mentioned above requires an operator to replace the conventional character set print wheel of a so-called daisy wheel printer with a special character set print wheel before instructing the system to print the extraordinary characters. In many cases, however, the display of the document to be printed does not accurately represent the extraordinary characters. While on these systems a document may be successfully printed using different character type fonts, and the number of character sets may be limited only by the number of character print wheels available, a corresponding display exhibits only one type font, so the extraordinary characters to be printed are not accurately represented on the display.

One of the earliest systems that incorporated two type fonts in a printer control system is disclosed in U.S. Pat. No. 3,283,305 issued to Hans, et al. In that system, two font formats are distinguished: human readable and machine readable fonts, such as MICR or OCR symbols. Codes are presented representing a particular font in which the respective information is to be printed and subsequently the information in either of the two fonts is stored in the same typeline buffer positions as the other font. The appropriate synchronization signal causes the information to be typed in the selected font. A typeline comprises 120 print wheels, one for each column of print, and each having 58 characters, human and machine readable, spaced about the periphery thereof. While the system disclosed in Hans, et al. may be adequate for printing either of two type fonts, no system is therein disclosed for accurately representing each of the type fonts on a visual display.

SUMMARY OF THE INVENTION

The present invention incorporates the use of external attribute logic. Invisible attributes, defined by the external attribute logic, specify display characteristics for each of up to 80 alphanumeric and other characters on each line of displayed text. Character attributes such as bold, blinking, reverse video, underscore and double underscore for each character can be specified in the present system without using character spaces on the display, thus preserving the relative positions of the characters with respect to one another and with respect to the margins of the lines in which the characters appear. Moreover, the attribute system of the present invention allows for the display of an additional set of characters or a second type font, having symbols equal in number to the number of characters in the conventional character set in the system. Thus, by using the external attribute logic of the present invention, up to 256 unique symbols may be exhibited on a CRT display.

In accordance with one embodiment of the present invention, there is provided a circuit for controlling attributes of a plurality of characters on a display. The circuit has a processor for controlling transfer of data associated with characters to be displayed and communications means connected to the processor. Display control means is also provided for controlling the display of characters. External attribute control means is connected to the communications means and to the display control means for providing attributes corresponding to the displayed characters.

In accordance with another embodiment of the present invention, the display control means described hereinabove includes data representative of a first set of characters. The display control means controls the display of the first set of characters on the display. External control means, including data representative of a second set of characters, controls the display of the second set of characters on the display.

Thus, the external control means can be an external attribute register or pair of registers to allow each character on the display line to have its own attribute or group of attributes and, further, to allow the system to use an alternate character type set for a second set of 128 characters which can be created in a single character generator.

BRIEF DESCRIPTION OF THE DRAWINGS

A complete understanding of the present invention may be obtained by reference to the accompanying drawings, when taken in conjunction with the detailed description thereof and in which.

DETAILED DESCRIPTION OF THE PREFERRED EMBODIMENT

Figure 2:
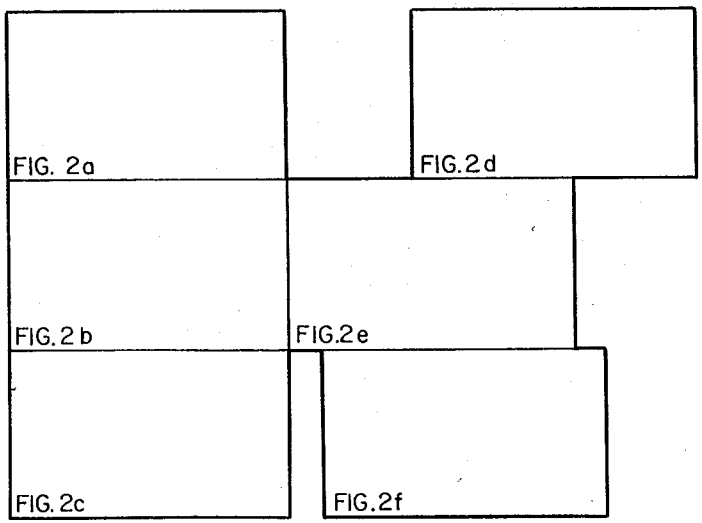
FIG. 2 is an interconnection diagram of FIGS. 2*a*–2*f* which when taken together are a schematic representation of the CRT controller and external attribute register of the present invention.

The CRT controller formats data from a memory into a video signal suitable for driving a CRT monitor or screen. The structure and operation of the CRT processor of the present invention can best be understood by referring to FIG. 1 which contains an Intel Corp. Model No. 8085A-2 microprocessor or central processing unit (CPU) 10 (hereinafter a microprocessor), 64K bytes of dynamic memory 12, supplied, for example, by the Intel Corp. in a 16K×1 format as Model No. 2118, an 8-bit data bus 14 and a 16-bit address bus 16, connected between the microprocessor 10 and the memory 12. To one or more of these internal buses are connected an Intel Corp. 8275 programmable CRT controller 20 and a General Instruments Co. Model No. AY-3-1015D serial to parallel universal asynchronous receiver/transmitter (UART) 22. The UART 22 communicates serially with a keyboard 24, the microprocessor 10 and the memory 12. A memory state controller 28 performs a refresh function to the memory 12 and performs an arbitration function between contending devices, as hereinbelow described.

An Intel Corp. Model No. 8237-2 direct memory access (DMA) controller 25 is connected to the data bus 14, and the address bus 16. When so connected, the DMA controller 25 refreshes memory 12 once per character line displayed on a screen, hereinbelow described. The DMA controller 25 has two registers per channel. One register is used to count the number of bytes transferred. The other is used as an address pointer.

An IPC interface 26 is connected via an IPC bus 30 to other processing units 32 within a word processing system, including a disk processor 34 which in turn can be suitably connected via serial lines to a printing device 36, such as a Ricoh Corp. Model No. RP1600 printer.

The CRT controller 20 is directly connected to a CRT monitor or display screen 38, such as a Motorola Corp. Model No. MD3000-140 monitor.

An oscillator 40 is connected to an input port of the microprocessor 10 and is driven by a crystal 42 to operate at a fixed and precisely determined frequency. The combination of the oscillator 40 and the crystal 42 forms a character clock. In operation, data is transferred from memory 12 to the CRT controller 20 via the DMA controller 25.

The CRT controller 20 is programmable. Consequently, the number of lines of alphanumeric information to be displayed on the screen 38, the number of characters to be displayed in a line, and the number of scan lines used to display a single row of characters can all be selected with appropriate modifications to the character clock 40 and 42.

In one embodiment, one of two standard display formats can be selected by specifying either one of two crystals 42, each having a different frequency. The crystal 42 can be installed at the factory or in the field by service personnel. Naturally the size of the displayed characters can be specified by a user with appropriate structural modifications to locate the crystal for convenient access for replacement. In one embodiment, two preferred crystal oscillator rates are 35.04 MHz and 35.38 MHz. In the preferred embodiment, the character size is nine vertical lines by seven horizontal dots, whereas the character font size is 12 lines by eight dots and the character block size is 12 lines by nine dots.

The IPC interface 26 is functionally equivalent to the IPC interface shown and described in detail in co-pending U.S. patent application Ser. No. 177,319, filed Aug. 12, 1980, for "Communications Systems for a Word Processing System Employing Distributed Processing Circuitry".

The CRT processor forms only part of a single data processing station. The other part of the circuitry is contained on the disk processor 34, which is connected to as many as four floppy disk drives, not shown, and to a printer. The disk processor 34 controls disk I/O functions and performs print formatting operations.

To transfer information from the keyboard 24 once one of its keys is depressed, a character corresponding to the depressed key is transmitted across the serial line from the keyboard 24 to the CRT controller 20 via the UART 22 which converts the data from serial form to parallel form. Once the UART 22 receives the character, it signals the microprocessor 10 by raising the interrupt RESTART (RST) 7.5 line on the microprocessor 10. The microprocessor 10 then discontinues processing and interrogates the UART 22. The character is moved to the accumulator of the microprocessor 10. From the accumulator, a keyboard handler program or subroutine residing in the program memory 12 transfers that piece of data to a buffer in the memory 12 of the CRT processor.

The CRT controller 20 issues a DMA request signal to the DMA controller 25 to fill the CRT controller's 20 internal data buffers. Likewise, the attribute control logic 21 issues DMA requrest signals to the DMA controller 25 to fill the attribute registers 21. The DMA controller 25 issues a HOLD request to the microprocessor 10. The microprocessor 10 completes its current machine cycle and acknowledges the request with a HOLD ACK signal to the DMA controller 25. The DMA controller 25 gets control of the address bus 16 (by issuing an address) and the control bus 18 (by activating the memory read and the I/O WRITE lines of the control bus), moving a byte of data from memory 12 into the destination register. Once the transfer is completed the HOLD line is lowered, allowing the microprocessor 10 to resume execution. The DMA controller 25 issues an interrupt signal to the microprocessor 10 at the end of each display line. The microprocessor 10 acknowledges the interrupt signal by reinitializing the DMA controller 25, instructing it to point address pointers therein to a new line of text.

Once the microprocessor 10 returns from its interrupt handler routine, it enters a program to format the CRT screen 38 and the new character is moved into a position in memory 12 so that it can be displayed on the screen 38.

Two line buffers, one for input and one for output, are provided within the CRT controller 20 and may be used in accordance with initialization parameters in the CRT controller 20. Of course, the initialization parameters and data allocation in memory 12 can be changed to conform to the characteristics of the crystal 42 used by the system. The input line buffer is filled or loaded with data by the DMA controller 25 at the current microprocessor operating rate. The output line buffer circulates one for each CRT scan line. When the CRT controller 20 completes the display of a line of text, the function of the input and output buffers is reversed.

When a printer operation is to take place, data from the CRT processor memory 12 is transferred to a memory within the disk processor 34 via the IPC interface 26 and IPC bus 30. This data transfer is shown and described in detail in co-pending U.S. patent application Ser. No. 177,319, as hereinabove referenced. The CRT processor establishes a master/slave relationship with the disk processor 34, and then transfers information to the disk processor 34 one byte at a time. The information, once received by the disk processor 34, is changed by programs within the disk processor 34 to a format acceptable to the printer 36.

When the CRT processor requires information from a disk, it signals the disk processor 34 by again establishing a master/slave relationship across the IPC interface 26 and IPC bus 30. The CRT processor transfers a data request to the disk processor 34. The disk processor 34 then accesses the data from the disk and transfers it to its own memory. The disk processor 34 then signals the CRT processor that it has received the data it requested. The data is then transferred once again across the IPC interface 26 and IPC bus 30 one byte at a time. All of these transfers are performed under the control of either the disk processor 34 or the CRT processor.

While the IPC interface 26 operates generally as shown and described in co-pending U.S. patent application Ser. No. 177,319, as hereinabove referenced, for each byte that is transferred, the slave microprocessor of the present invention is placed into a hold state. In the system disclosed in the aforementioned patent application, a memory interleaving scheme was constructed to utilize the full bandwidth of the memory. That is not required in the present invention. Circuitry is simplified such that when data is transferred to the slave microprocessor, it is placed in the hold state for the duration of the transfer for each byte that is transferred. The use of this procedure reduces the number of components required to enable master/slave operations.

Figure 1:
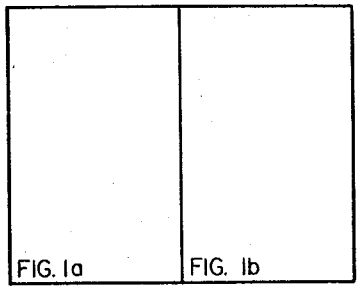
FIG. 1 is an interconnection diagram of FIGS. 1*a* and 1*b* which when taken together are a block diagram of a word processing system with external attribute logic embodying the present invention.
Figure 1A:
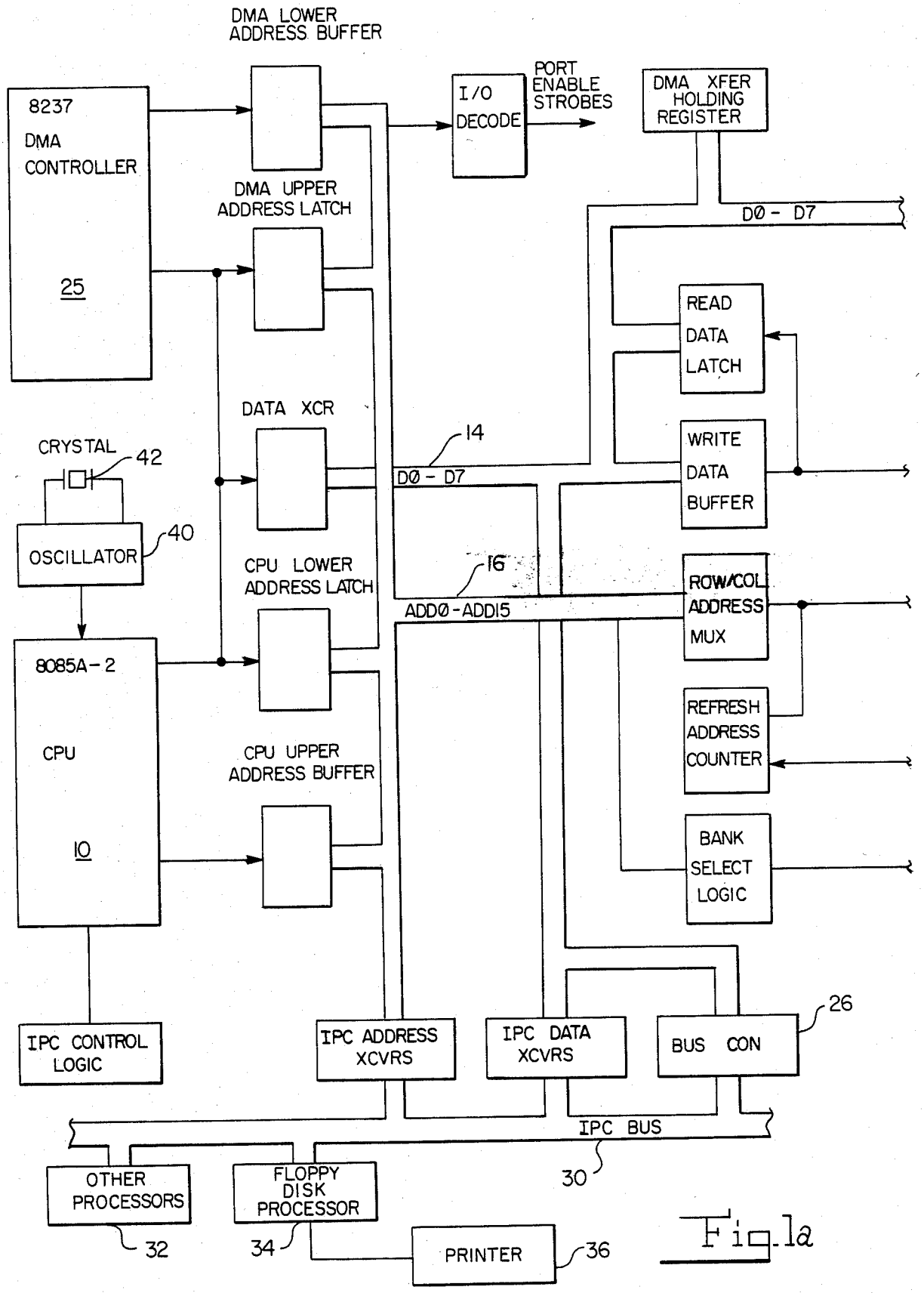
Figure 1B:
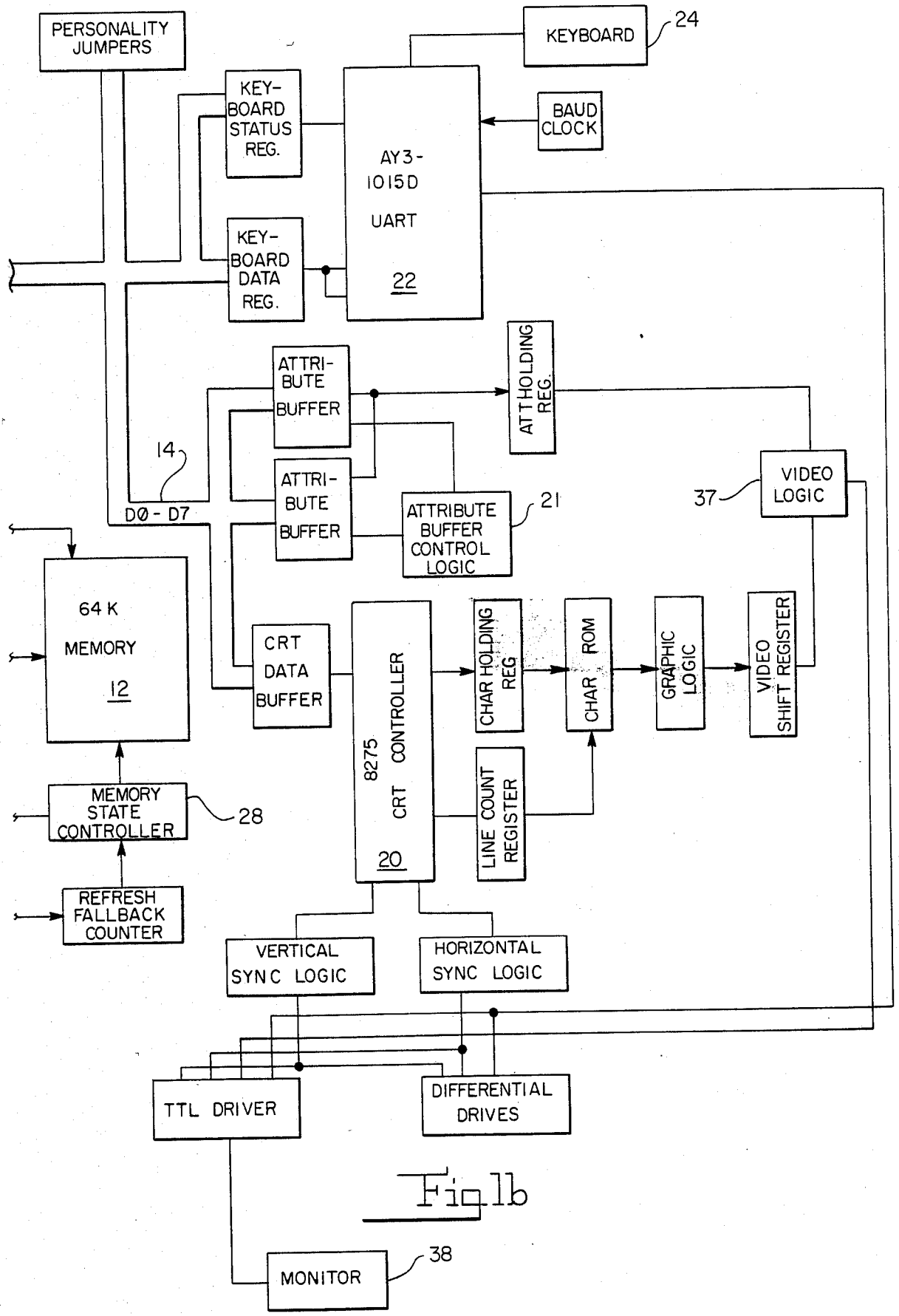
Figure 2A:
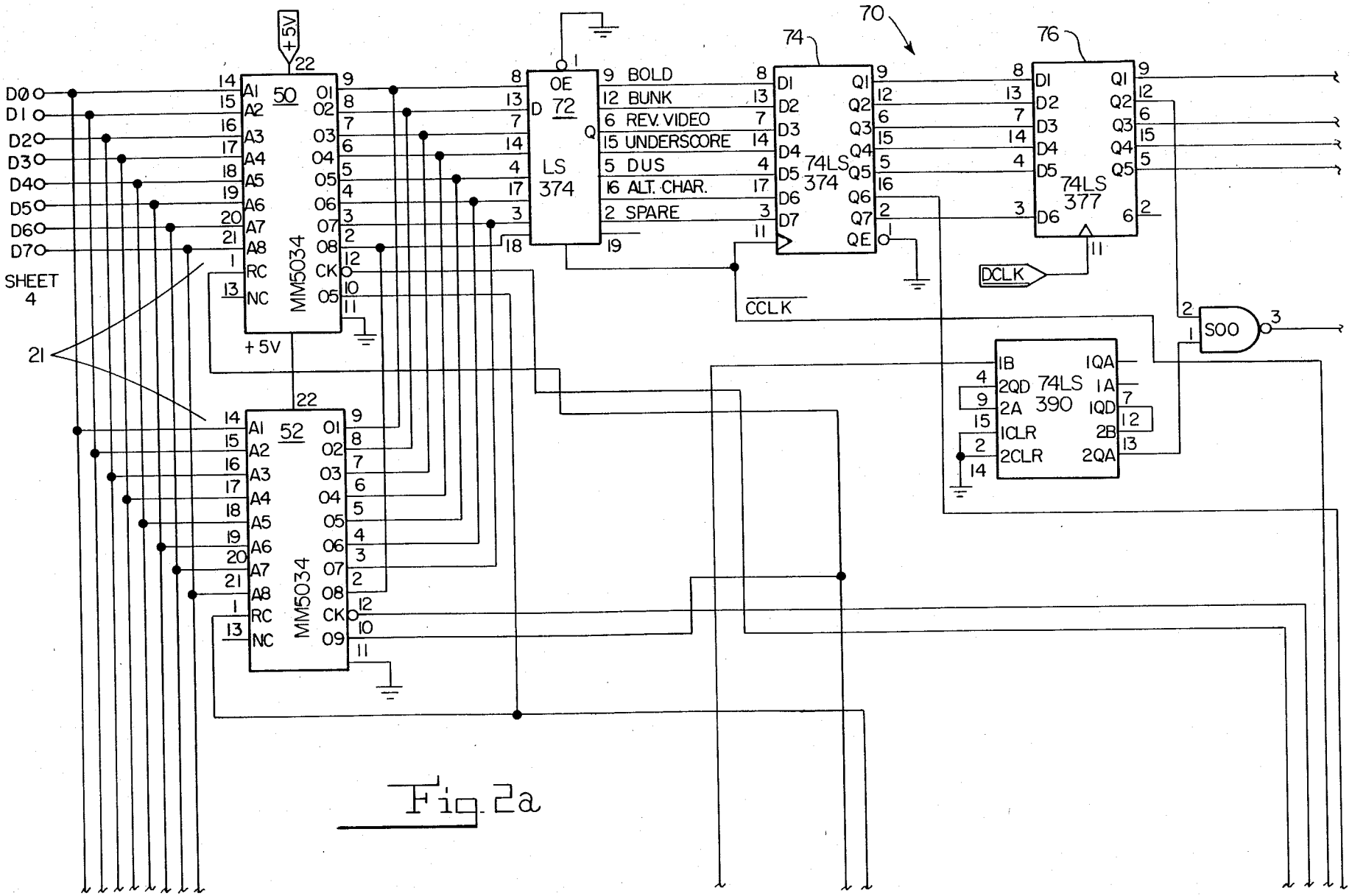
Figure 2B:
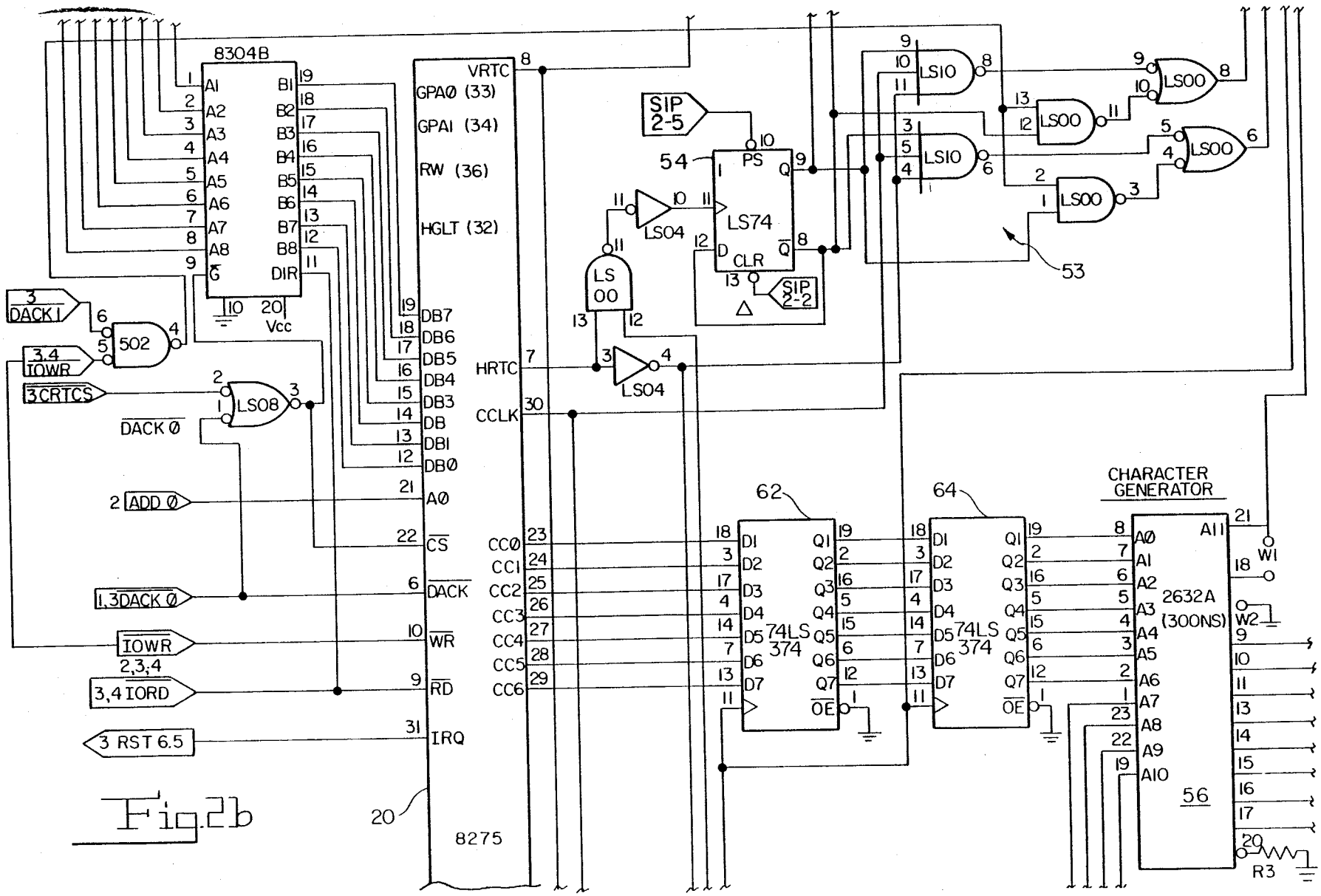
Figure 2C:
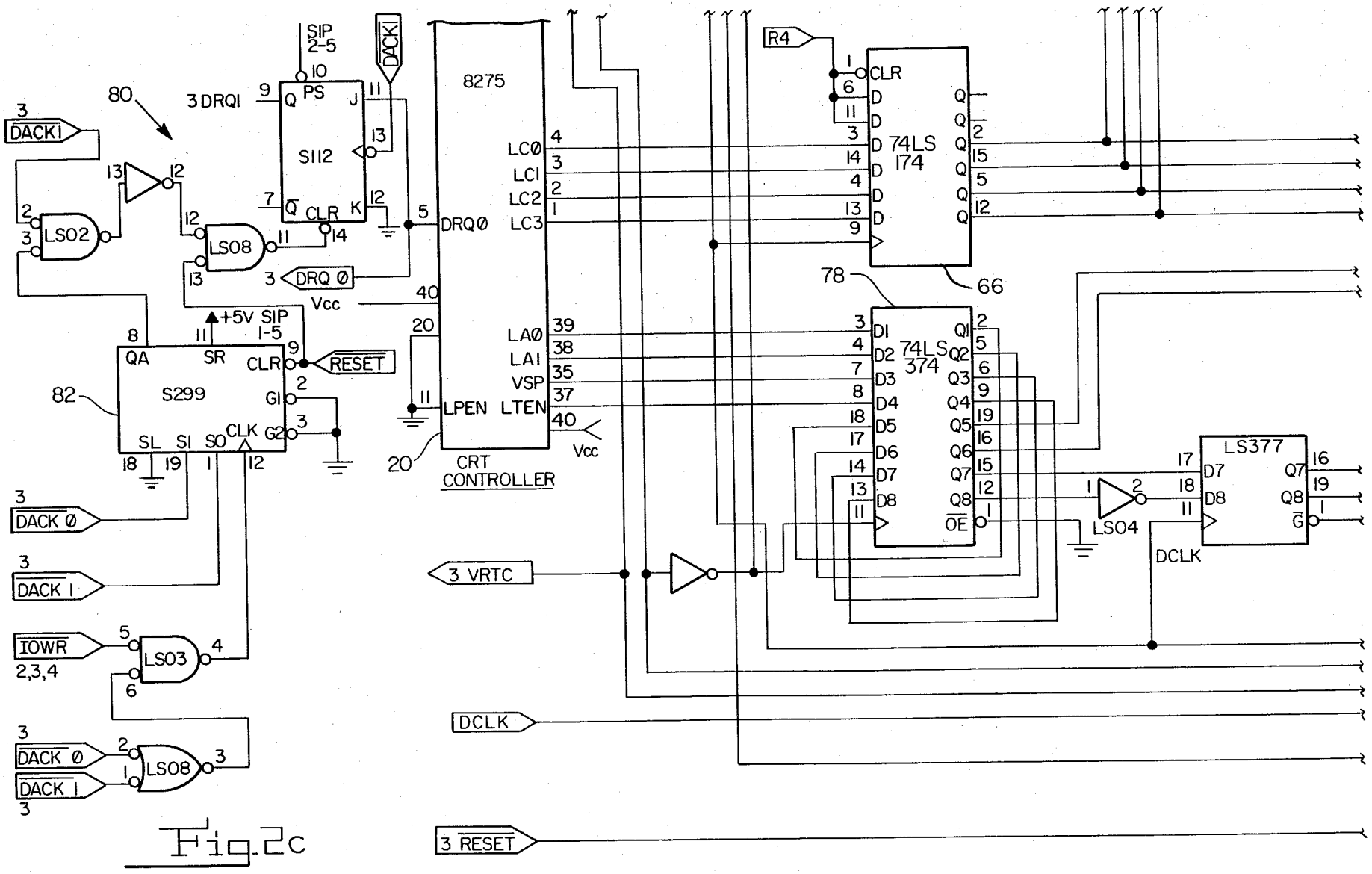
Figure 2D:
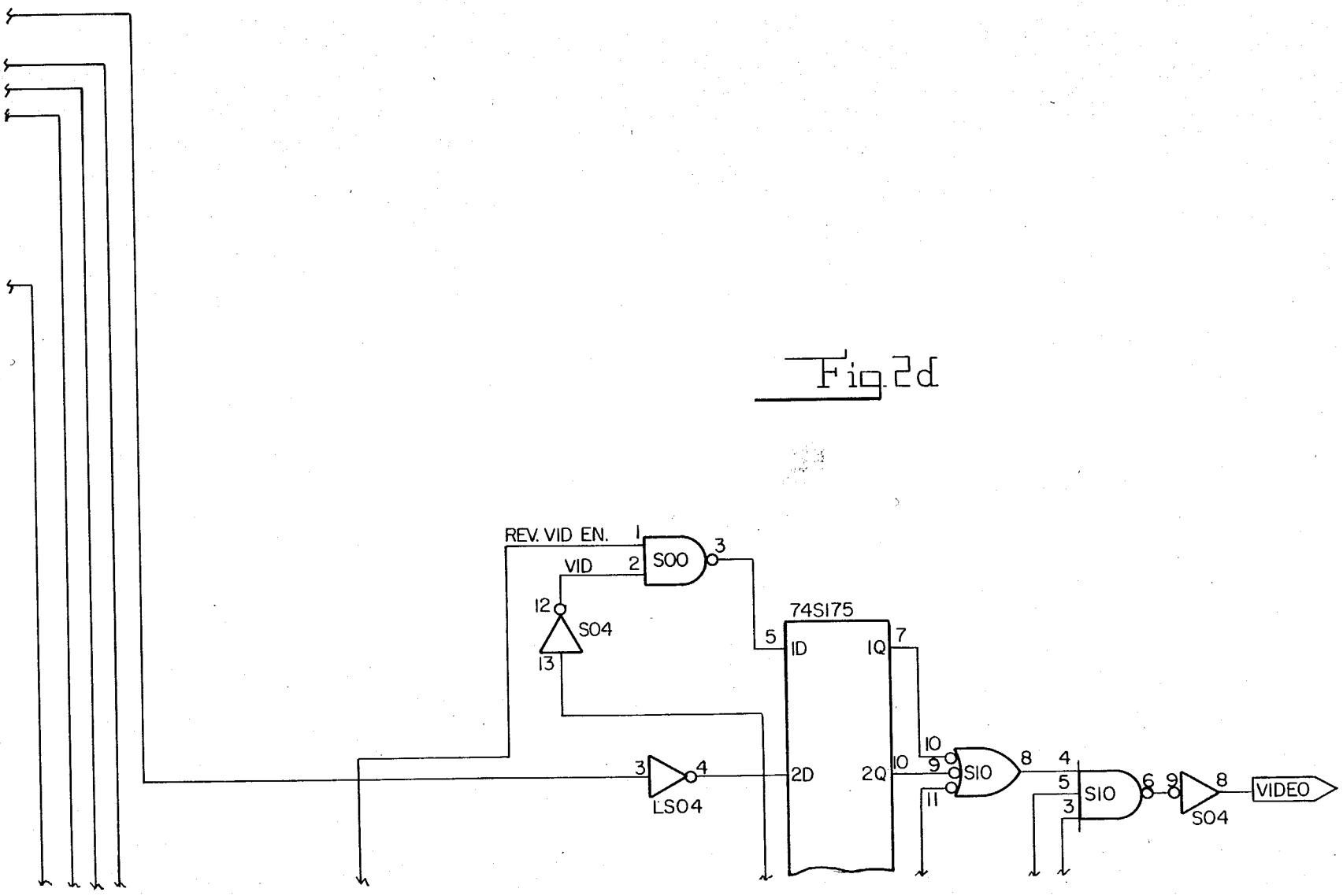
Figure 2E:
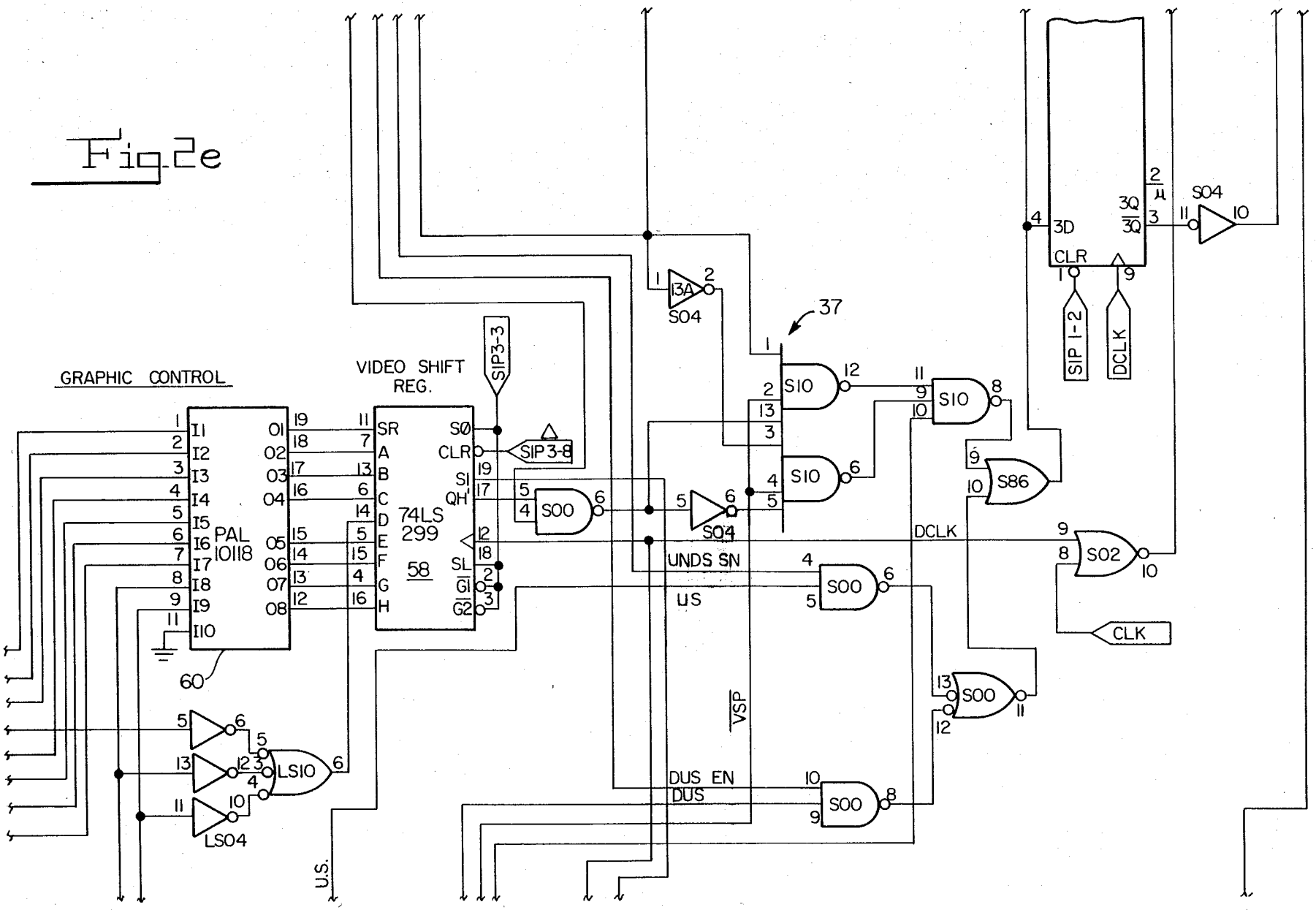
Figure 2F:
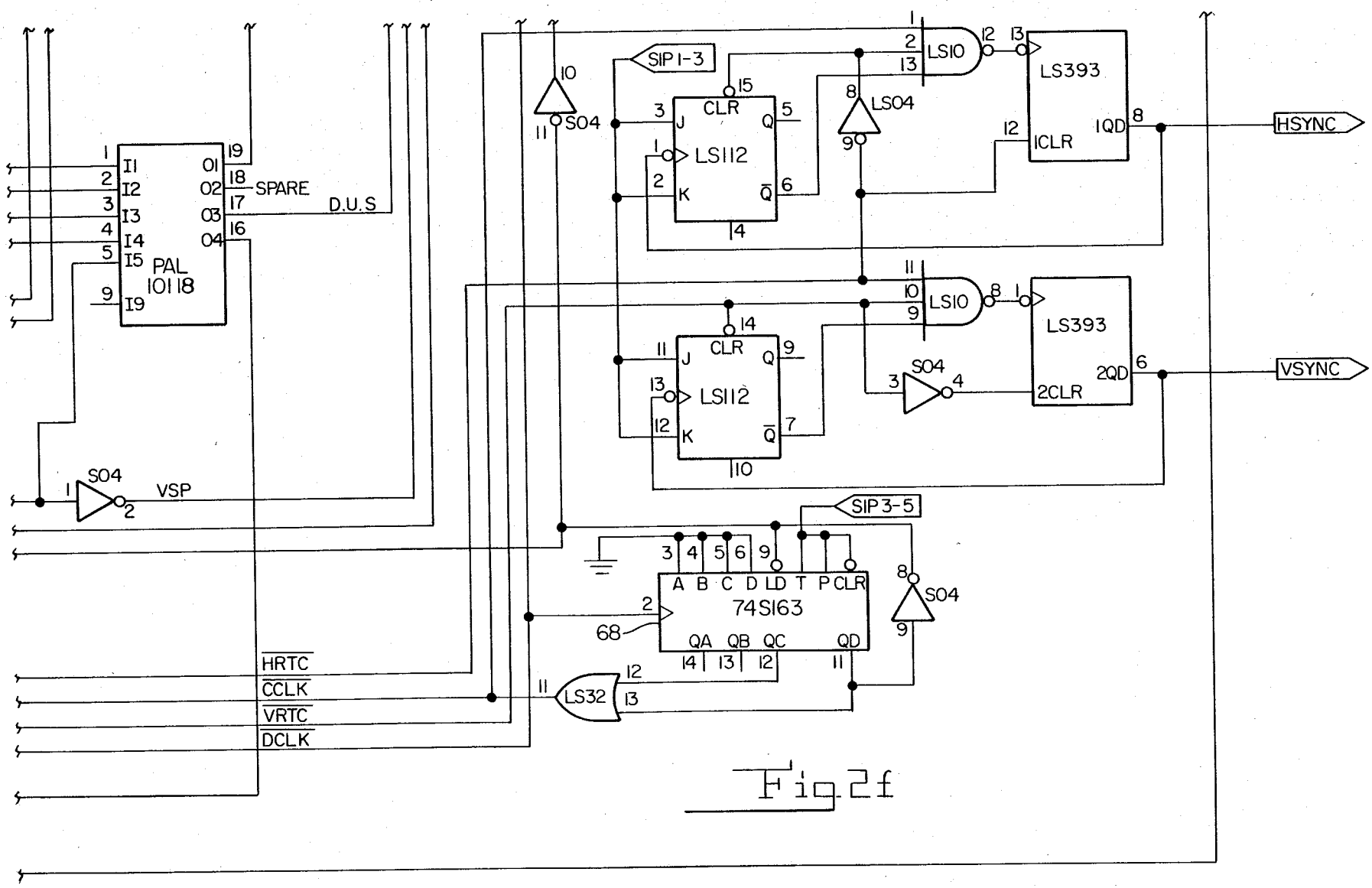
Figure 1:
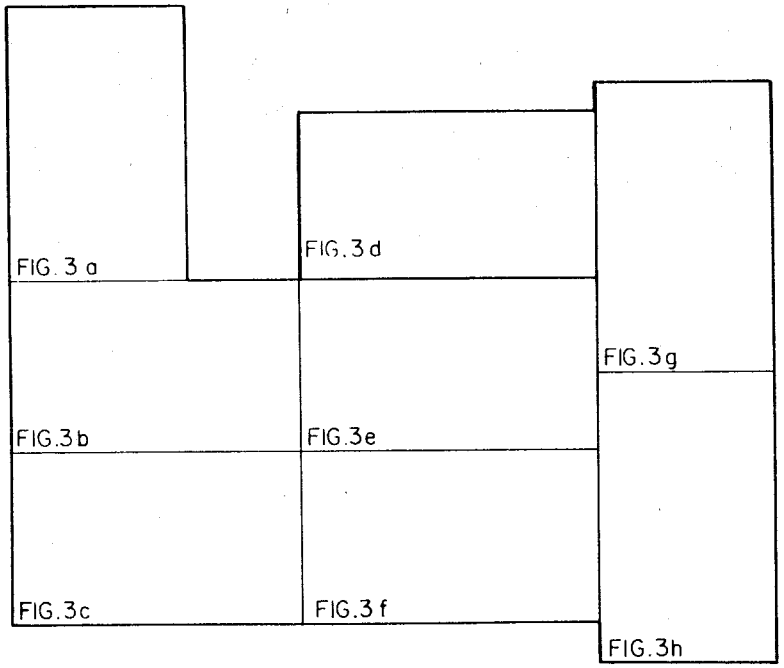
Figure 3A:
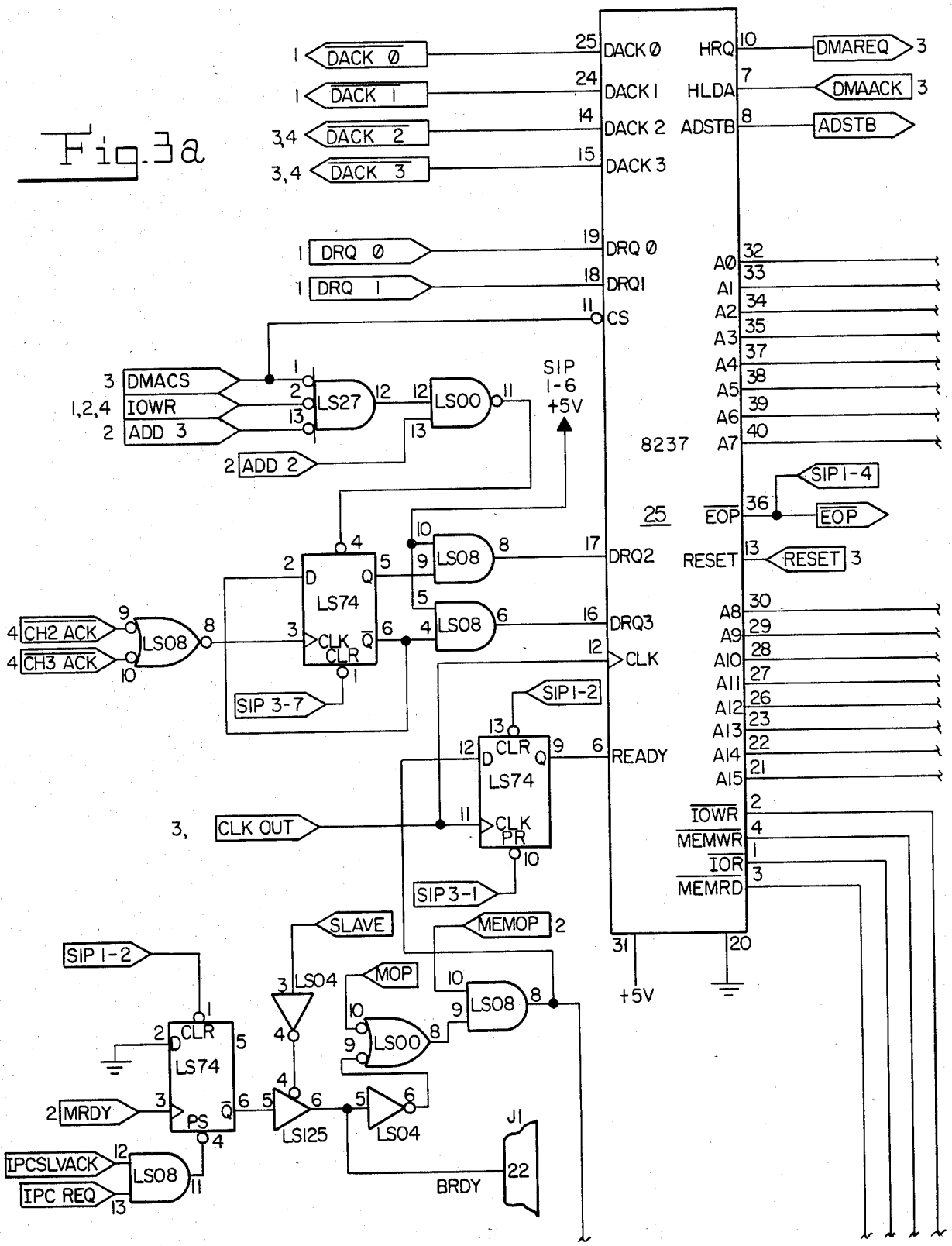
FIG. 3 is an interconnection diagram of FIGS. 3*a*–3*h* which when taken together are a schematic representation of the CRT microprocessor and the DMA controller of the present invention.
Figure 9B:
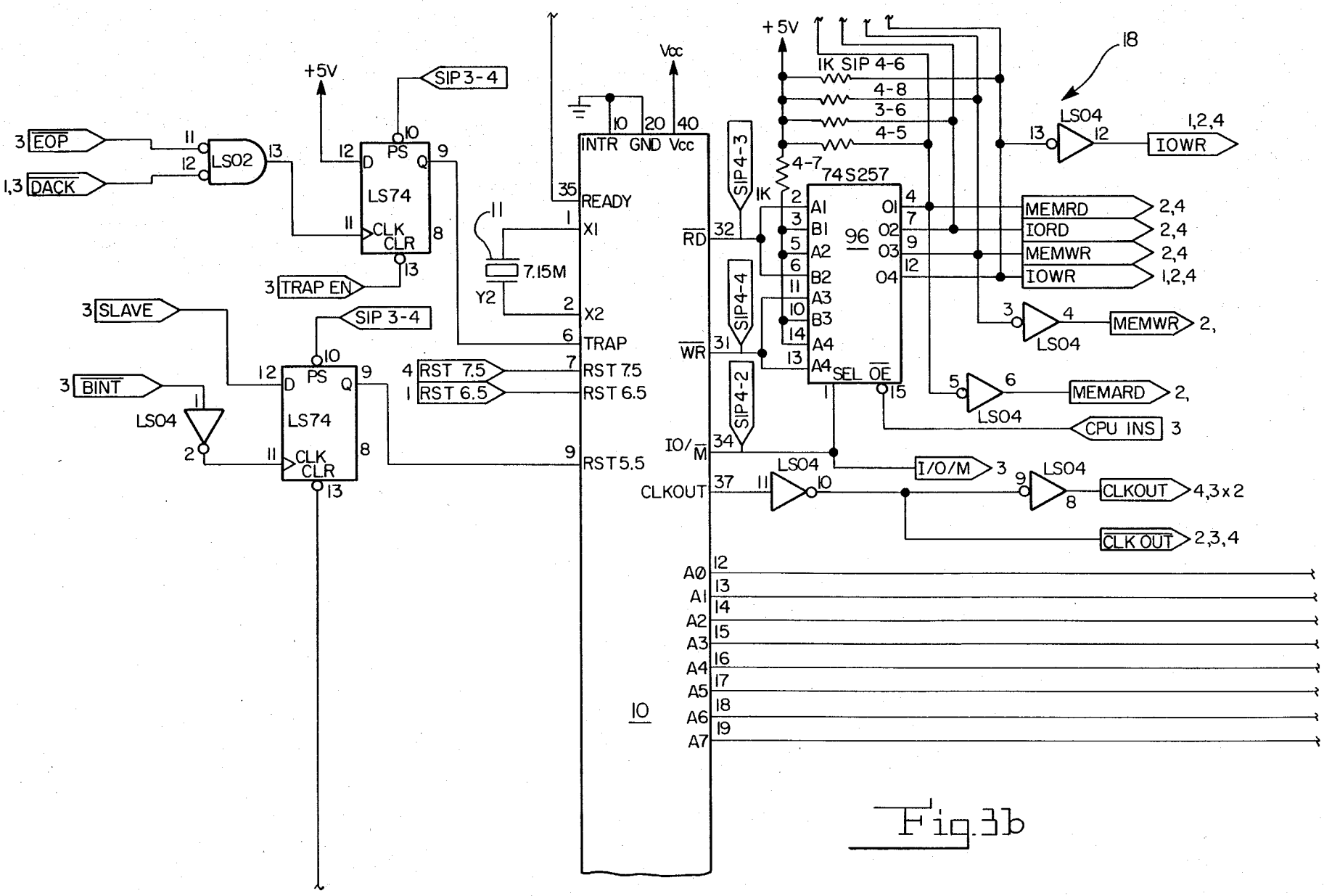
Figure 1C:
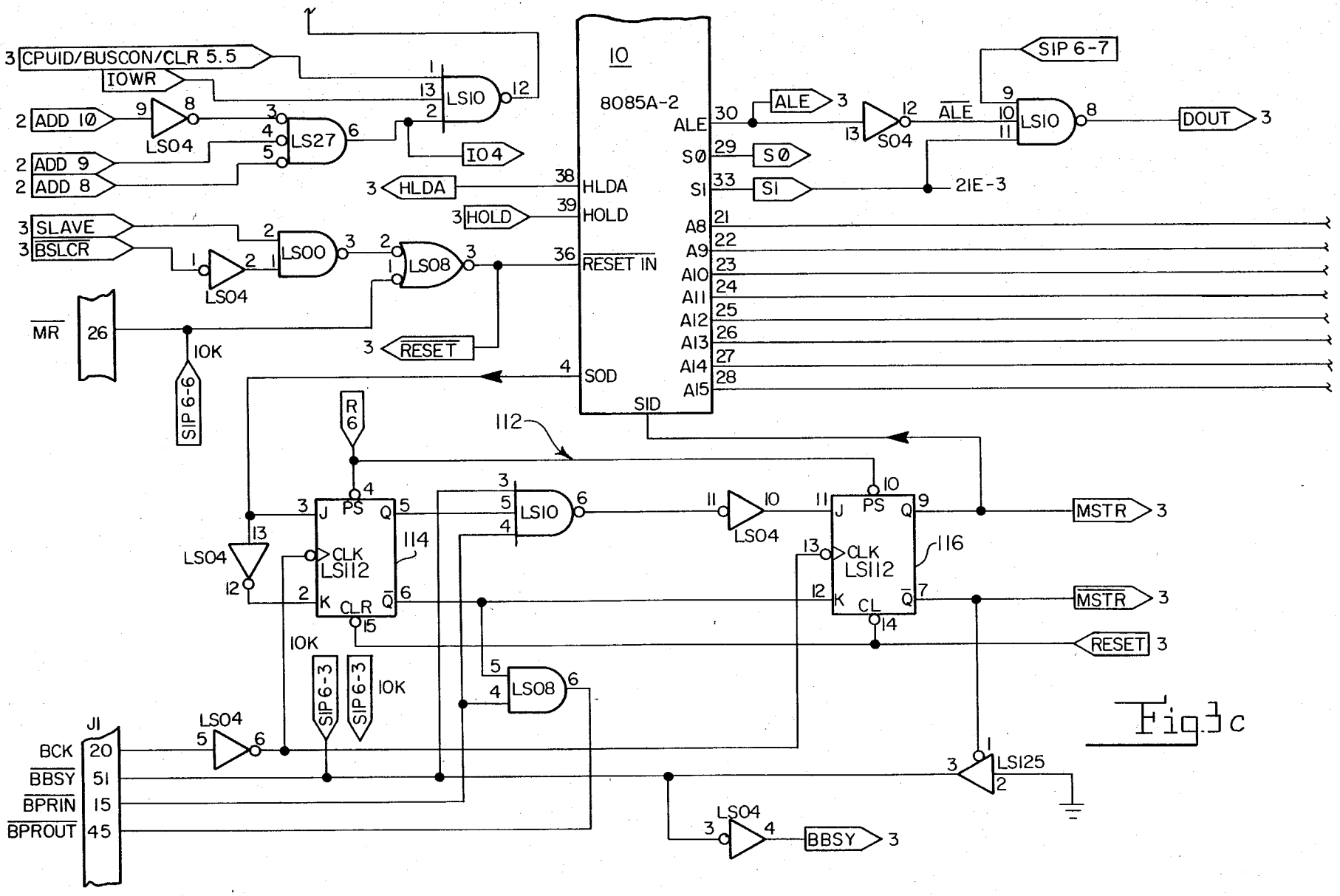
Figure 3D:
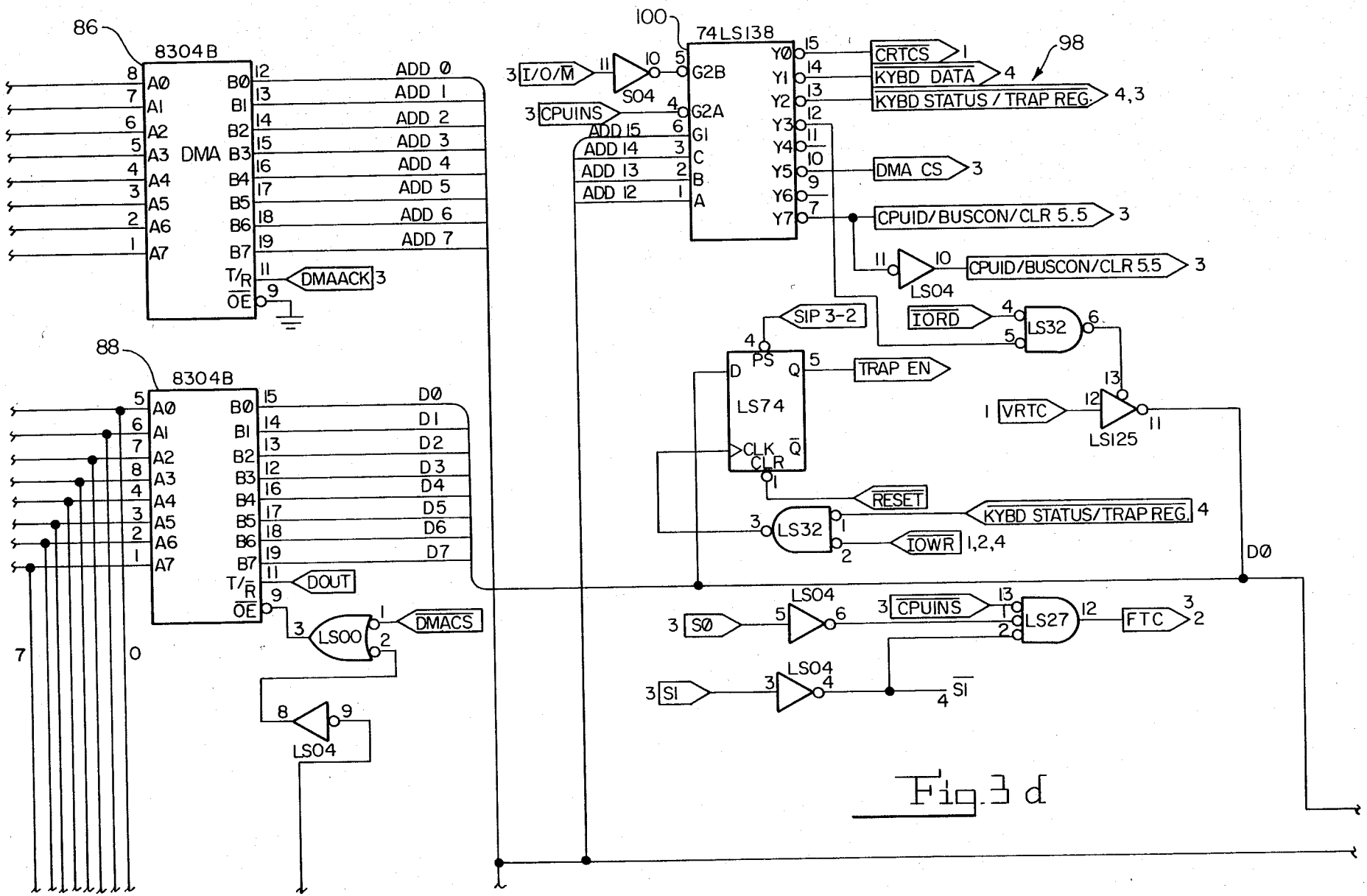
Figure 14E:
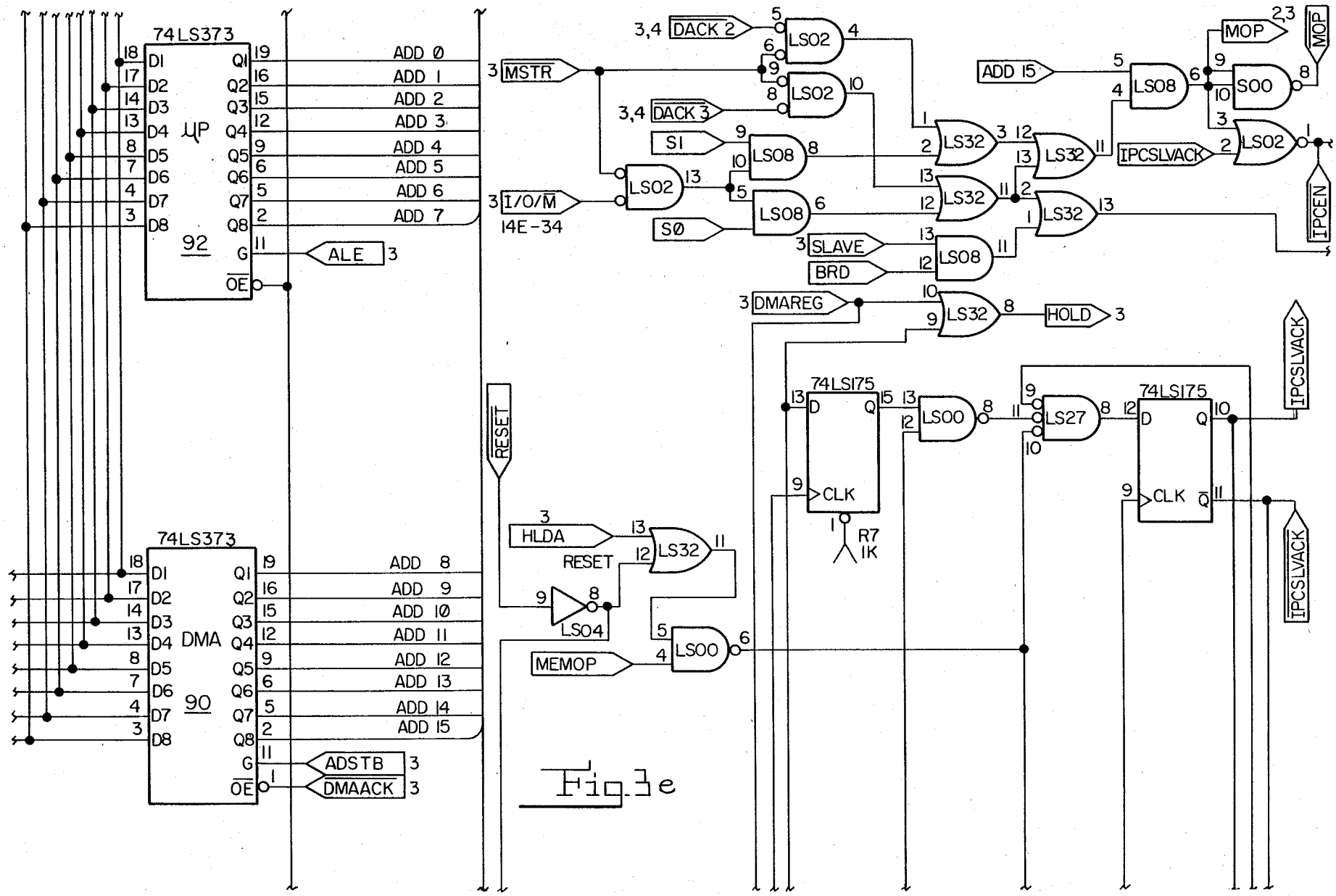
Figure 16F:
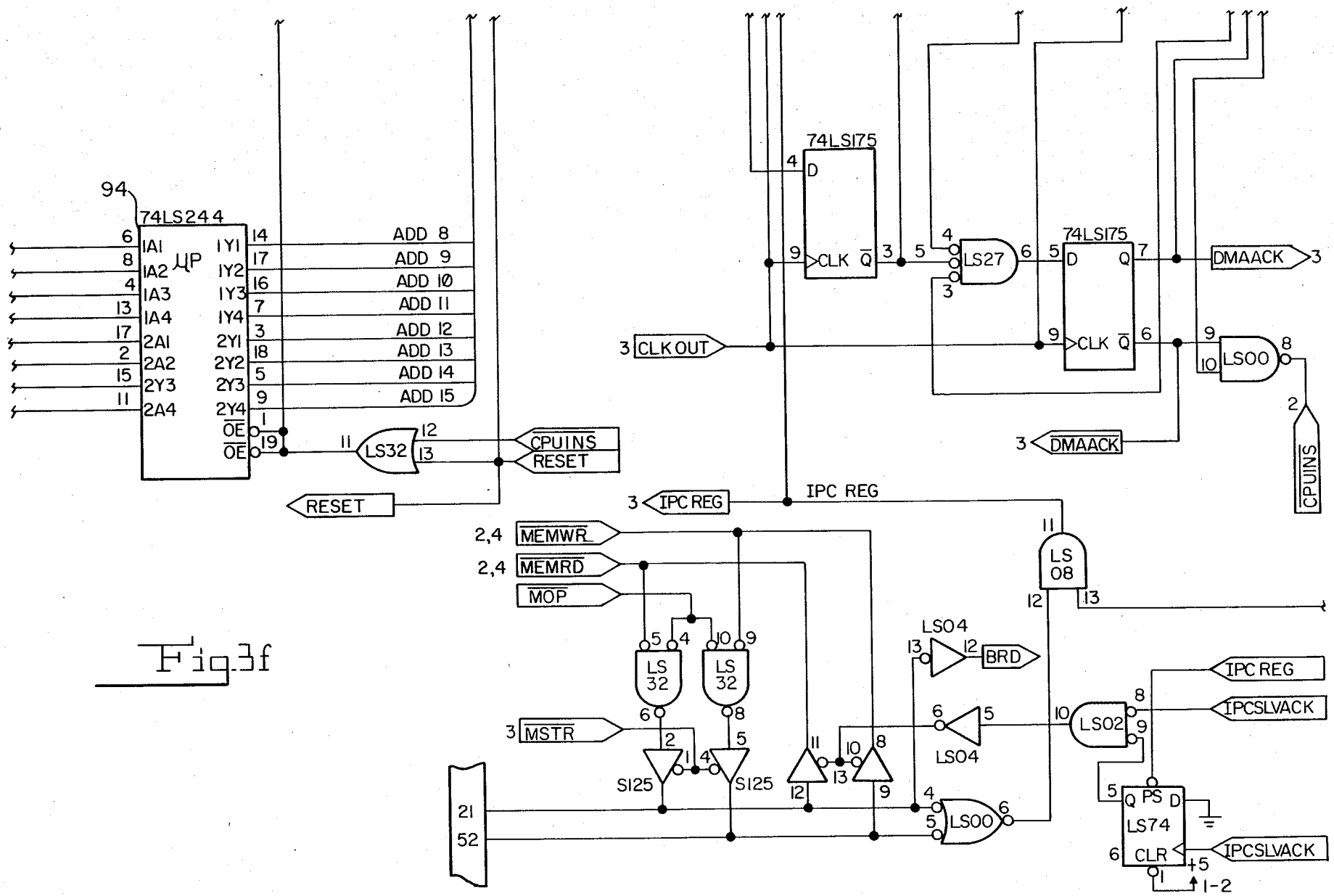
Figure 3G:
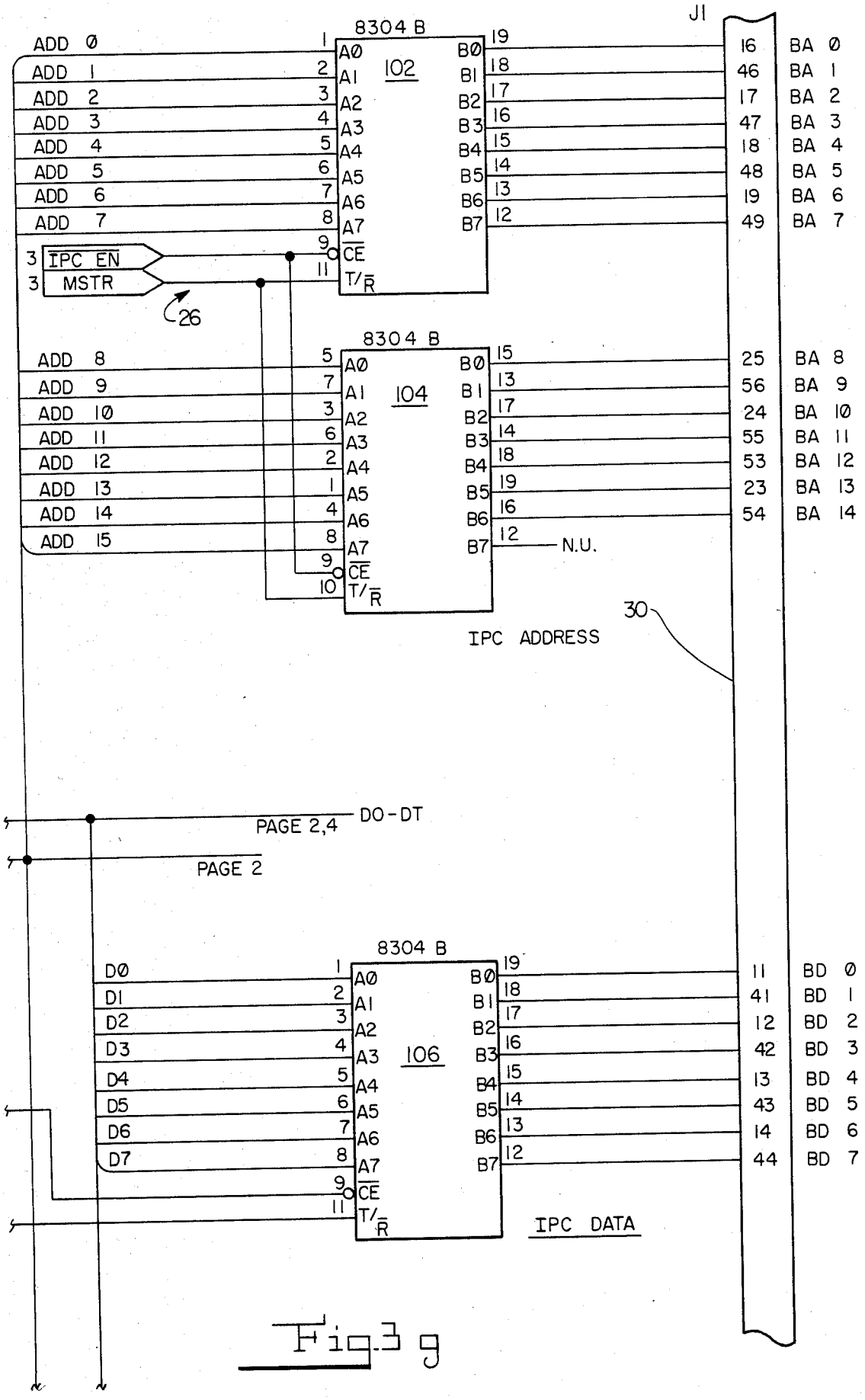
Figure 3H:
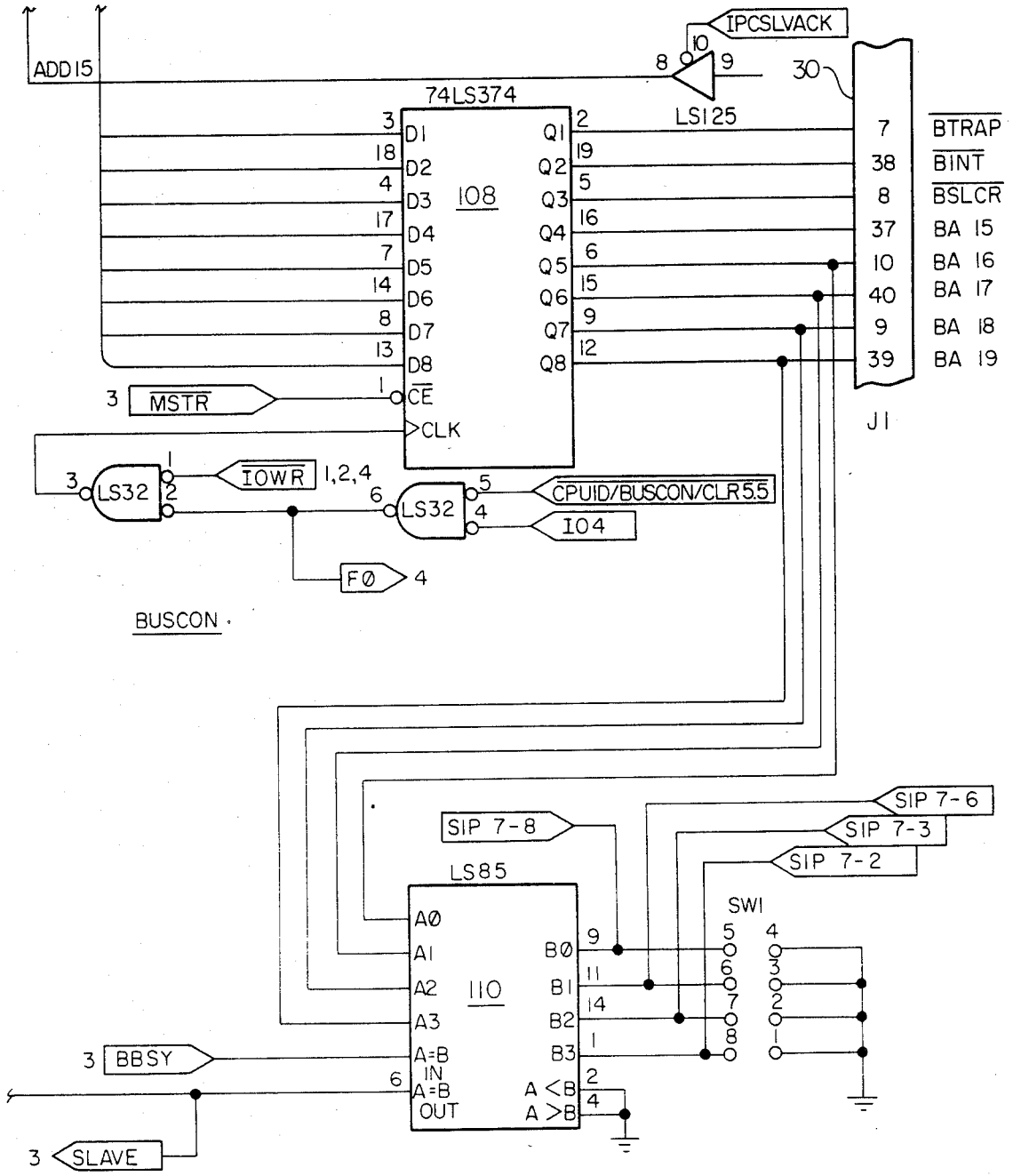

FIG. 2 is a detailed view of the CRT controller 20 as shown in FIG. 1, and also includes attribute registers shown generally at 21 and video logic shown generally at 37.

Referring now also to FIG. 2, a portion of a CRT processor card including the CRT controller and circuitry associated therewith, is shown. Reference numeral 21 refers generally to devices marked 50 and 52 which are 80-byte long, 8-bit wide external attribute registers, manufactured by the National Semiconductor Corp. as Model No. MM5034. These circulating dynamic shift registers 50 and 52 store attribute information that is associated with each character to be displayed on a line of the display.

Each character code has assocated with it an eight-bit attribute. The bits of this attribute are defined as shown below.

| Bit | Attribute |
|---|---|
| 0 | BOLD |
| 1 | BLINK |
| 2 | REVERSE VIDEO |
| 3 | UNDERSCORE |
| 4 | DOUBLE UNDERSCORE |
| 5 | ALTERNATE CHARACTER SET |
| 6 | NOT USED |
| 7 | NOT USED |

Each attribute is selectable independently of the others and is valid only for the single character associated therewith. Any character can have any combination of attributes.

The BOLD attribute specifies a 25% increase in brightness for the displayed character associated therewith. The BLINK attribute specifies a character blink rate of 1.2 Hz. The REVERSE VIDEO attribute causes the corresponding 12-line by nine-dot character block associated with the character to become a reverse video field. A cursor is produced by actuating the REVERSE VIDEO attribute associated with a blank character. The UNDERSCORE attribute provides a single underline one line from the bottom of the character block. The DOUBLE UNDERSCORE attribute provides a double width underline using the bottom two lines of the character block. The ALTERNATE CHARACTER SET attribute selects logic to decode the character code from the alternate 128-symbol character set, not from the conventional 128-symbol character set.

The two external attribute registers 50 and 52 function in parallel with one register being filled from a direct memory access (DMA) channel in the system bus while the second register outputs information through the video circuitry 37.

At the end of a particular display line the two registers 50 and 52 exchange functions. Thus, the external attribute register pair 50 and 52 is used in a ping-pong arrangement, one register of which is connected to the DMA channel while the other register outputs information to the video circuitry 37. After a line is displayed, the DMA function is performed by the second external attribute register 50 or 52 while the information is displayed through the first external attribute register 52 or 50 via video circuitry.

Information enters the register pair 21 on lines D0 through D7 which is a common data communications bus. The data from lines D0–D7 is clocked into either external attribute register 50 or external attribute register 52 by clock signals that are derived by the circuitry associated with the attribute buffer control, shown generally at reference numeral 53.

A flip flop 54 selects which external attribute register 50 or 52 is associated with the DMA channel and which with the video section. The external attribute register 50 or 52 associated with the DMA channel is clocked at the end of each DMA transfer. There are 80 DMA transfers for each display line.

The external attribute register 50 or 52 associated with the video circuitry is clocked at the video refresh rate, as controlled by the memory refresh controller 28, in conjunction with the CRT controller 20. Both the CRT controller 20 and the external attribute register 50 or 52 that is associated with the video refresh circuitry are synchronized to the refresh rate which is derived from the oscillator 40. As characters are assembled and exit from the CRT controller 20, over lines CC0 through CC6, the attributes are presented from the external attribute register 50 or 52 in synchronism. Both the character and the corresponding attribute enter a register pipeline so that they arrive at the video circuitry 37 in synchronism.

The video logic 37 of the CRT processor card converts the ASCII character information presented by the CRT controller 20 into a video signal. The conversion is performed by applying the ASCII character to the input of a character generator 56 which generates information corresponding to the dot pattern for a particular character. The character generator 56 is a ROM manufactured by the Intel Corporation as Model No. 2632A. Alternatively, an EPROM such as part number 2732A may be used.

The address input for the character generator 56 consists of both the ASCII character value and the line count. The output of the character generator 56 is a series of dots corresponding to the line being addressed for the specified character. The eight bits of information output by the character generator 56 is latched into a video shift register 58 where it is shifted out serially at the character dot rate of 17.69 MHz in the preferred embodiment.

The remainder of the video circuitry 37 synchronizes the character information with the selected attribute. The outputs of the CRT processor card are the video (VIDEO) output signal, the horizontal sync (HSYNC) output signal and the vertical sync (VSYNC) output signal, used to synchronize the monitor operation of the CRT monitor 38 with the video signal. The CRT controller 20 synchronizes the timing information used to generate the HSYNC and VSYNC signals with the character information which eventually takes the form of the video signal.

As hereinabove mentioned, a number of attributes can be represented by the CRT processor card, such as bold, blink, reverse video, underscore, double underscore, and selection of an alternate set of 128 characters. The CRT processor provides access to 256 characters. The CRT controller 20 provides direct access to 128 characters over the seven lines CC0 through CC6. The CRT controller 20 in conjunction with bit 5 from one of the external attribute registers 21 addresses a set of 256 characters. The character generator 56 can be programmed with 256 characters, i.e., two sets of 128 characters each, in any desired format. Examples of such formats are: elite, gothic, italics, mathematical, scientific, modern, any foreign language, or pica type styles.

As hereinabove stated, the external attribute registers 50 and 52 are circulating dynamic shift registers. They can be loaded with new information or they can be set into a recirculating mode so that they continually recirculate data internal to the device. When one of the external attribute registers 50 or 52 is attached to the DMA channel, information is input; when attached to the video circuitry 37, the external attribute register 50 or 52 recirculates information that is already stored.

A graphics control programmable array logic (PAL) 60 is connected to the character generator 56. The graphics control PAL 60 can be used for generating thin line graphics in any one of 11 right angle patterns.

The CRT controller 20 transmits over lines CC0 through CC6 a signal to a pipeline which consists of two octal latches 62 and 64. The octal latches 62 and 64 synchronize the character codes with the line codes and generate and signal to the character generator 56. Similarly over lines LC0 through LC3, the CRT controller 20 is connected to a hex latch 66 used to synchronize the line count with the horizontal sync signal.

The dot clock (DCLK) signal is applied from the oscillator 40 to a divide-by-9 counter 68. The output from this counter 68 is a character clock (CCLK) signal. The CCLK signal is then applied to the CRT controller 20 which uses the clock signal to output the character codes over lines CC0 through CC6 and lines LC0 through LC3. This CCLK signal is also used to generate the vertical and horizontal sync signals.

Connected to the attribute registers 21 is an attribute pipeline 70 which consists of three octal latches 72, 74 and 76. The attribute pipeline 70 synchronizes the attribute bits with the video signal. The output of the attribute pipeline 70 is applied to the video logic 37.

The graphics control pipeline 70 consists primarily of an octal latch 78 which is connected to the CRT controller 20 over lines LA0, LA1, VSP, and LTEN. Ports LA0 and LA1 select the graphic character to be displayed. The LA0 and LA1 signals are combined with the LTEN signal via the graphics pipeline 78 to the graphics control PAL 60. The graphics control PAL 60 then modifies the signal from the character generator 56 to generate the appropriate graphics characters.

DMA arbitration logic is shown generally at reference numeral 80. It consists of a bi-directional 8-bit shift register 82. This arbitration logic 80 ensures that the attribute buffer requests the same amount of data at the same time as does the CRT controller 20. Thus, the CRT controller 20 and the attribute register 21 are in synchronism before entering the video signal.

Referring now also to FIG. 3, the microprocessor 10 receives a clock signal from the crystal 11. The DMA controller 25 is connected to arbitration buffers 86, 88 and 90. Similarly the microprocessor 10 is connected to arbitration buffers 88, 92 and 94. The arbitration buffers 86, 88 and 90 allow either the DMA Controller 25 or the microprocessor 10 to access the information on the address bus 14 and on the data bus 16.

The control bus 18 includes a four bit 2-to-1 multiplexer 96. The purpose of the control bus 18 is to select the function to be performed by the microprocessor 10, which can be memory read, memory write, I/O read or I/O write. I/O decode circuitry is shown generally at reference numeral 98. It consists of a 3-to-8 decoder 100. The purpose of the I/O decoder 98 is to select the appropriate I/O port for the function to be performed.

The DMA controller 25 and the microprocessor 10 operate at the same speed, based on the crystal 11. The interprocessor communications (IPC) interface is shown generally at reference numeral 26. It consists of three buffers 102, 104 and 106. The IPC buffers 102, 104 and 106 are connected to the IPC bus 30 and are bi-directional for transferring data onto or from the IPC bus 30. Master arbitration logic 112 is connected to the microprocessor 10. The master arbitration logic 112 consists of two flip flops 114 and 116, which together determine whether the microprocessor 10 can become a master processor. This is done by determining the status of the IPC bus 30. If the IPC bus 30 is not being used or if it is occupied by a lower priority master microprocessor, then the microprocessor 10 can become a master. A bus master request is issued by setting the serial output data (SOD) line of the microprocessor 10. If the master arbitration logic 112 indicates that the microprocessor 10 can become a master i.e., the microprocessor 10 has an active bus request and has a higher priority than all other processors 32 with active bus requests, the microprocessor 10 polls its serial input data (SID) line to determine whether it has been granted the bus request. At this point the microprocessor 10 may generate signals through the bus control register 108 to address a slave processor. The microprocessor 10 may reset a pending bus request or relinquish its position as bus master by resetting the SOD line.

Once the microprocessor 10 is master, it presents the desired slave processor address to the IPC bus 30 for monitoring by the other processors 32. The processor 32 having the specified four-bit address now becomes the slave processor. A slave address comparator 110 is connected to the IPC bus 30 to indicate when the instant microprocessor 10 is to become the slave processor of another processor 32. In the preferred configuration, the slave processor is the floppy disk processor 34.

Either the upper 32K bytes of memory or the lower 32K bytes of memory of the slave processor is mapped into the upper 32K byte portion of the master microprocessor memory 12. The part of the slave processor memory accessed is determined by the control bus 18 and bus control register 108 associated therewith. To access the memory of a slave processor, the master microprocessor 10 generates read/write signals to the slave. Slave processor program execution is interrupted only while the slave processor memory is being accessed and resumes thereafter.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

What is claimed is:

1. A circuit for controlling attributes of a plurality of characters on a display, comprising:

(a) a processor for controlling the transfer of data associated with characters to be displayed, said associated data consisting of first data including elements defining said characters ordered in accordance with the positions of said characters on said display and second data in one-to-one correspondence with said first data, each element of said second data defining predetermined attributes for its associated character;

(b) a memory operatively connected to said processor for storing said data;

(c) communications means responsive to said processor and operatively connected to said memory for transferring said data from said memory;

(d) display control means, responsive to said processor and operatively connected to said communications means for controlling the display of characters on said display in one-to-one correspondence with the elements of said first data, and for controlling the attributes of said characters in accordance with attribute input signals, said display control means including a first pair of line buffer registers for storing elements of said first data to be displayed as respective alternate lines of characters in correspondence to said elements of said first data;

(e) external attribute control means operatively connected to said communications means and to said display control means for providing said attribute input signals, said external attribute control means including a second pair of buffer registers for storing elements of said second data, each member of said second pair of buffers corresponding to a member of said first pair;

(f) synchronizing means for alternately reading members of said first pair of buffers synchronously with corresponding members of said second pair of buffers to define alternate lines of said characters and corresponding attributes to be displayed; and, (g) said processor controlling said display control means, said external attribute control means and said synchronizing means to alternately and synchronously output one of said first buffers and the corresponding one of said second buffers to define a line of said characters and corresponding attributes to be displayed in accordance with the elements of said first data and of said second data stored in said first and second buffers being output, and, substantially simultaneously, inputting other elements of said first and second data into the other members of said first and second pairs of buffers to define the next succeeding line of characters and corresponding attributes to be displayed.

2. The circuit of claim 1 wherein said communications means comprises a DMA controller, said display control means comprises an integrated circuit CRT controller, a character generator and attribute control logic, and said second buffers of said external attribute control means comprises multi-bit shift registers.

3. The circuit of claim 1 wherein each element of said second data comprises a plurality of bits, the state of each of said bits corresponding to the presence or absence of a preselected attribute.

4. The circuit of claim 2 wherein each element of said second data comprises a plurality of bits, the state of each of said bits corresponding to the presence or absence of a preselected attribute.

5. The circuit of claim 2 wherein said shaft registers are recirculating shift registers, whereby said elements of said second data may be recirculated so as to define the attributes of a succeeding line without the need to reload said shift registers for each line.

* * * * *